US006294864B1

(12) United States Patent
Mochizuki et al.

(10) Patent No.: US 6,294,864 B1
(45) Date of Patent: Sep. 25, 2001

(54) COLOR CATHODE-RAY TUBE WITH SHADOW MASK HAVING L-SHAPED BI-METALLIC SPRINGS

(75) Inventors: Tatsuya Mochizuki; Nobuhiko Hosotani; Yasumasa Tsuchiya; Takehiko Ueyama; Masakazu Tsuruoka, all of Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/254,182

(22) PCT Filed: Sep. 2, 1996

(86) PCT No.: PCT/JP96/02469

§ 371 Date: Mar. 2, 1999

§ 102(e) Date: Mar. 2, 1999

(87) PCT Pub. No.: WO98/10460

PCT Pub. Date: Mar. 12, 1998

(51) Int. Cl.[7] ..... H01J 29/80
(52) U.S. Cl. ..... 313/405; 313/404; 313/402
(58) Field of Search ..... 313/402, 403, 313/404, 405, 406, 407, 408, 476

(56) References Cited

U.S. PATENT DOCUMENTS 3,330,980 * 7/1967 Shrader ..... 313/404
3,754,157 * 8/1973 Yamazaki et al. ..... 313/404
3,803,436 * 4/1974 Morrell ..... 313/405
3,935,497 * 1/1976 Cowles et al. ..... 313/405
4,315,189 * 2/1982 Goto et al. ..... 313/405
4,524,298 * 6/1985 Pawlikowski et al. ..... 313/405
4,572,983 * 2/1986 Ragland, Jr. ..... 313/405
4,728,853 * 3/1988 Sone et al. ..... 313/406
4,827,180 * 5/1989 Sone et al. ..... 313/404
5,502,350 * 3/1996 Uehara et al. ..... 313/405

* cited by examiner

*Primary Examiner*—Nimeshkumar D. Patel
*Assistant Examiner*—Mariceli Santiago
(74) *Attorney, Agent, or Firm*—Antonelli, Terry, Stout & Kraus, LLP

(57) ABSTRACT

A shadow mask spring for a color cathode ray tube having a generally rectangular shadow mask structure including a shadow mask and a support frame for holding the shadow mask. Shadow mask springs serve for holding the support frame inside a panel having a phosphor screen adjacent thereto and engage with panel pins for holding the shadow mask structure. Each of the shadow mask springs includes L-shaped base plate and a joined plate secured to one end of the base plate. The base plate has a phosphor screen side metal portion and an electron gun side metal portion with the phosphor screen side metal portion having a smaller thermal expansion coefficient than that of the electron gun side metal portion. An other end of the base plate is secured to a side of the support frame. The joined plate is engageable with a panel pin and the secured portion of the one end of the base plate and the joined plate is located at a position closer to the phosphor screen than the secured portion of the other end of the base plate and the support frame.

5 Claims, 7 Drawing Sheets

COLOR CATHODE-RAY TUBE WITH SHADOW MASK HAVING L-SHAPED BI-METALLIC SPRINGS

BACKGROUND OF THE INVENTION

The present invention relates to a color cathode ray tube; and, more specifically, the invention relates to a color cathode ray tube in which beam landing errors resulting from the movement of a shadow mask structure due to a temperature rise hardly occur.

A color cathode ray tube generally comprises a front panel having a phosphor screen that serves as a picture screen, a neck portion accommodating the electron guns, and a funnel portion connecting the front panel and the neck portion. Electron beams emitted from the electron guns are deflected in horizontal and vertical directions by a deflection yoke on their way to the phosphor screen so that they are scanned two-dimensionally over the phosphor screen formed on the inner surface of the panel to form an image on the screen. At this time, the electron beams for red (R), green (G) and blue (B) phosphors are selected by a shadow mask installed on the inner side of the panel and impinge on the phosphors of corresponding colors, causing these phosphors to emit light and form an image on the phosphor screen.

The shadow mask structure comprises a shadow mask having a large number of electron beam passing openings, a support frame for holding the shadow mask, and mask springs for holding the support frame inside the panel of the color cathode ray tube. The shadow mask structure is suspended inside the panel and is supported through the mask springs on panel pins embedded in the panel. The shadow mask is made of, for example, invar (with an expansion coefficient of, for instance, $1.5\times10^{-6}/°$ C.), the support frame is made of steel (with an expansion coefficient of, say, $1.09\times10^{-5}/°$ C.), and the mask spring is made of stainless steel (with an expansion coefficient of, say, $1.04\times10^{-5}/°$ C.). The expansion coefficient referred to here is the coefficient of linear expansion.

FIG. 1 shows the relation between the ambient temperature and the beam drift. The panel is normally formed of glass. The expansion coefficient of glass is $8\times10^{-6}$ to $10\times10^{-6}$ which is larger than that of a shadow mask assembly having the above construction. Reference number la represents the glass panel at an ambient temperature of 20° C. and 1*b* represents the glass panel at 40° C. It is seen that the panel 1*b* is expanded circumferentially outwardly compared with the panel 1*a*. The shadow mask 2 on the other hand remains in almost the same state with a change in the ambient temperature. Thus, a phosphor screen portion 3, on which the electron beam B after passing through an opening in the shadow mask strikes when the panel is in the state 1*a*, moves circumferentially outwardly to a position 4 when the panel is in the state 1*b*. That is, the electron beam apparently shifts toward the center of the panel in that the electron bream will now strike a point closer to the center of the panel 1*b* relevant to the position 4.

Such a drift of the electron beam on the phosphor screen depending on the ambient temperature surrounding the cathode ray tube, which is generally called an electron beam drift, is hereinafter referred to as an ambient temperature drift. The ambient temperature drift causes a color purity defect. The ambient temperature drift apparently causes the electron beam to move inwardly over the phosphor screen, as discussed above. The mask springs are made of a bimetal to improve the ambient temperature drift. The warp of the bimetal mask springs is utilized to move the whole shadow mask away from the phosphor screen to optimize the displacement of the electron beam and therefore prevent a degradation of the color purity. When different materials are used for the shadow mask and the support frame, the amounts of their expansion differ because they have different expansion coefficients.

When such a cathode ray tube is operated, a generally-called doming phenomenon occurs in which the shadow mask starts to expand immediately after the start of tube operation and moves toward the phosphor screen. The doming phenomenon in which the shadow mask moves toward the phosphor screen can be suppressed because the invar material used for the shadow mask has a relatively small expansion coefficient. When the display tube continues to be used for a long period of time, the shadow mask is extended circumferentially outwardly by the expansion of the support frame because the amounts of expansion of the shadow mask and the support frame differ. This results in generally-called electron beam drift in which the electron beam is displaced over the phosphor screen. The electron beam drift that results from the difference in expansion between the shadow mask and the support frame when the tube is used for a long period will be hereinafter referred to as a long time drift. The long time drift causes the electron beam to move circumferentially outward over the phosphor screen, resulting in a color purity defect.

FIG. 2 shows the amount of beam displacement when bimetal mask springs are used. The beam displacement is given a plus sign (+) when the electron beam, after having passed through the electron beam passing opening, apparently moves toward the center of the panel when viewed from the front of the panel and a minus sign (−) when it apparently moves outwardly. In a cathode ray tube which has been optimally set at the ambient temperature of 20° C. when manufactured, for example, the electron beam displacement when the tube is used at the ambient temperature of 20° C. is represented by line 5 and the electron beam displacement at 40° C. is represented by line 6. When bimetal mask springs are used, the distance between lines 5 and 6 is narrow, and the ambient temperature drift is improved, whereas, as for the long time drift, the shadow mask moves further away from the phosphor screen, increasing the drift of the electron beam.

FIG. 3 shows the amount of beam displacement when monometal mask springs are used. The beam displacement is given a plus (+) sign when the electron beam, when viewed from the front of the panel, apparently moves toward the center of the panel and a minus (−) sign when it apparently moves outward. The use of monometal mask springs can suppress the displacement of the electron beam by the offset produced by the ambient temperature drift in view of the long time drift. The electron beam displacement, however, is greatly affected by the ambient temperature at which the tube is used, resulting in a wide range of variation of the displacement. In a cathode ray tube which has been optimally set at the ambient temperature of 20° C. when manufactured, for example, the electron beam displacement when the tube is used at the ambient temperature of 20° C. is represented by line 7, and the displacement when the tube is used at 40° C. is represented by line 8. In this case, there is an ambient temperature difference of 20° C. The maximum difference of the electron beam displacement at this time is therefore greatly affected by the ambient temperature. Further, the color purity setting is already exceeded before operating the tube.

Although the use of the monometal mask springs can suppress the electron beam displacement due to the long time drift by the offset produced by the ambient temperature drift, the use of monometal mask springs leads to a bad characteristic of the ambient temperature drift. It has therefore been difficult to improve both electron beam drifts, i.e., the ambient temperature drift and the long time drift, at the same time, in that either the ambient temperature drift or the long time drift must be sacrificed, even with the use of bimetal or monometal mask springs for the sides of such a conventional shadow mask structure.

A tube with a dot type phosphor screen structure, in particular, has a purity problem significantly more serious than that of the stripe type phosphor screen structure. Further, in high definition color display tubes with a shadow mask hole pitch, which determines the phosphor screen dot pitch, of below 0.31 mm, the problem is more serious. This purity problem with high definition displays with substantially more than 1,000 horizontal scanning lines is also critical.

To solve these problems, various techniques have been disclosed in Japanese Patent Laid-Open Nos. 14851/1989, 209635/1989 and 44915/1994, but they can solve only one of the problems of ambient temperature drift and long time drift.

SUMMARY OF THE INVENTION

A color cathode ray tube which has a generally rectangular shadow mask structure and panel pins for holding the shadow mask structure, the shadow mask structure including a shadow mask, a support frame for holding the shadow mask, and mask springs for holding the support frame inside the panel, is characterized in that the mask springs each comprise a base plate which is formed of an L-shaped bimetal, and a joined plate which is provided as a monometal welded to one end of the base plate, and in that the base plates are secured to sides of the support frame by means of the joined plates engaged with the panel pins. This arrangement can prevent color purity degradation resulting from the beam landing shift which is caused by the difference in expansion between the mask springs and the support frame and also prevent color purity degradation caused by changes in ambient temperature, thereby maintaining a stable color purity.

This invention is particularly effective in a cathode ray tube which incorporates a shadow mask having a support frame with a larger expansion coefficient than that of the shadow mask.

BEST MODE FOR CARRYING OUT THE INVENTION

Figure 1:
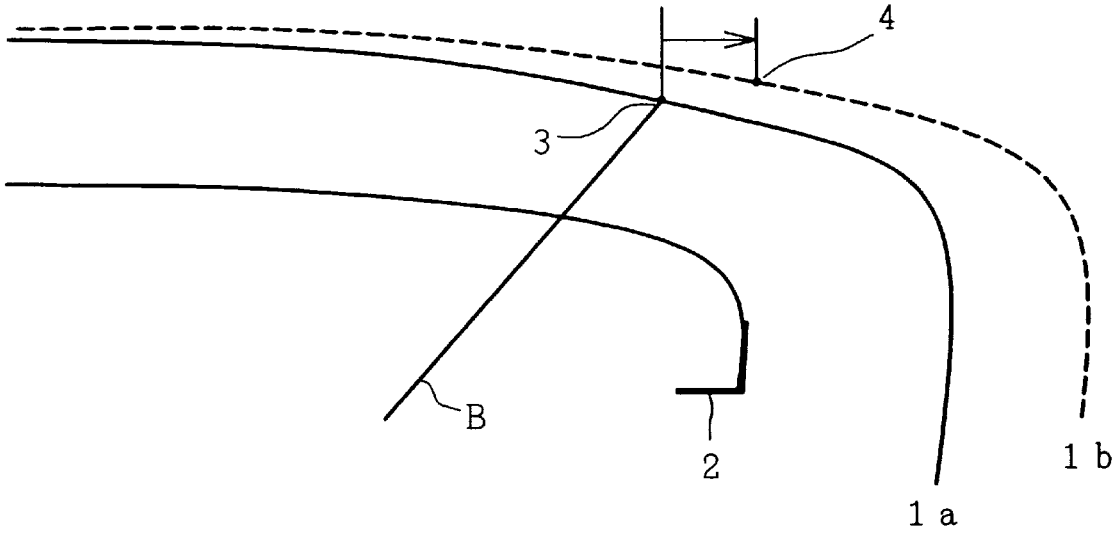
FIG. 1 (PRIOR ART)
FIG. 1 is a diagram showing panel expansion and beam displacement, resulting from changes in ambient temperature.
Figure 2:
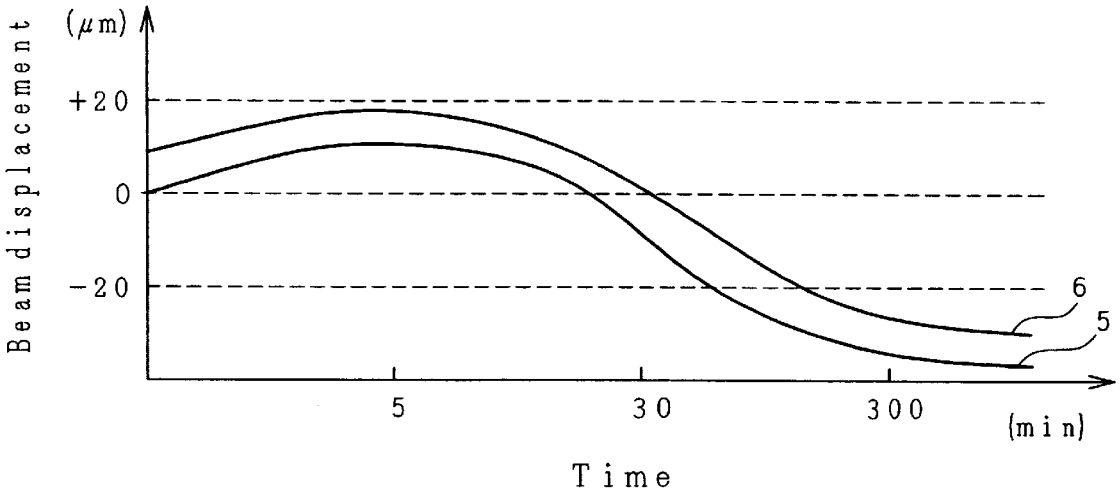
FIG. 2 (PRIOR ART)
FIG. 2 is a graph showing the amount of electron beam displacement when conventional bimetal mask springs are used.
Figure 3:
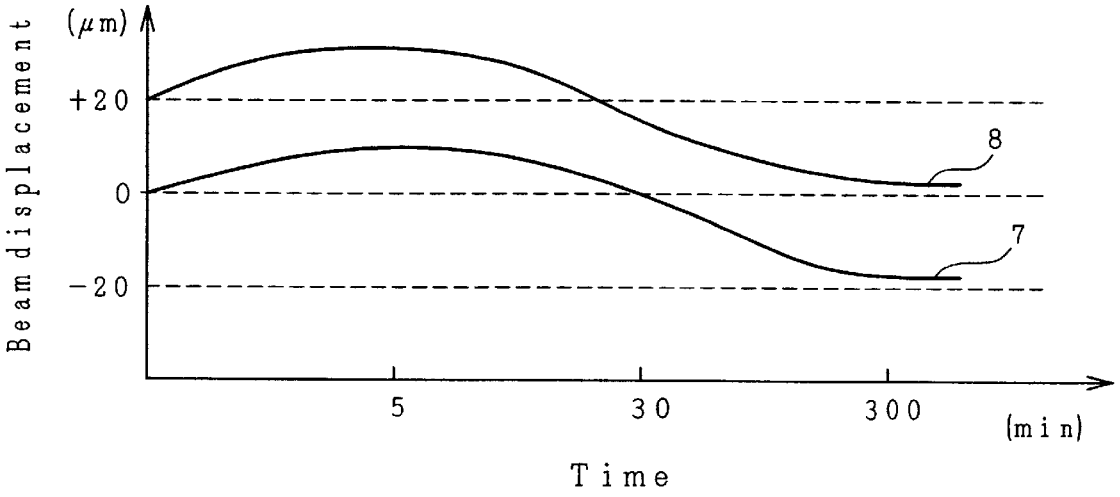
FIG. 3 (PRIOR ART)
FIG. 3 is a graph showing the amount of electron beam displacement when conventional monometal mask springs are used.
Figure 4:
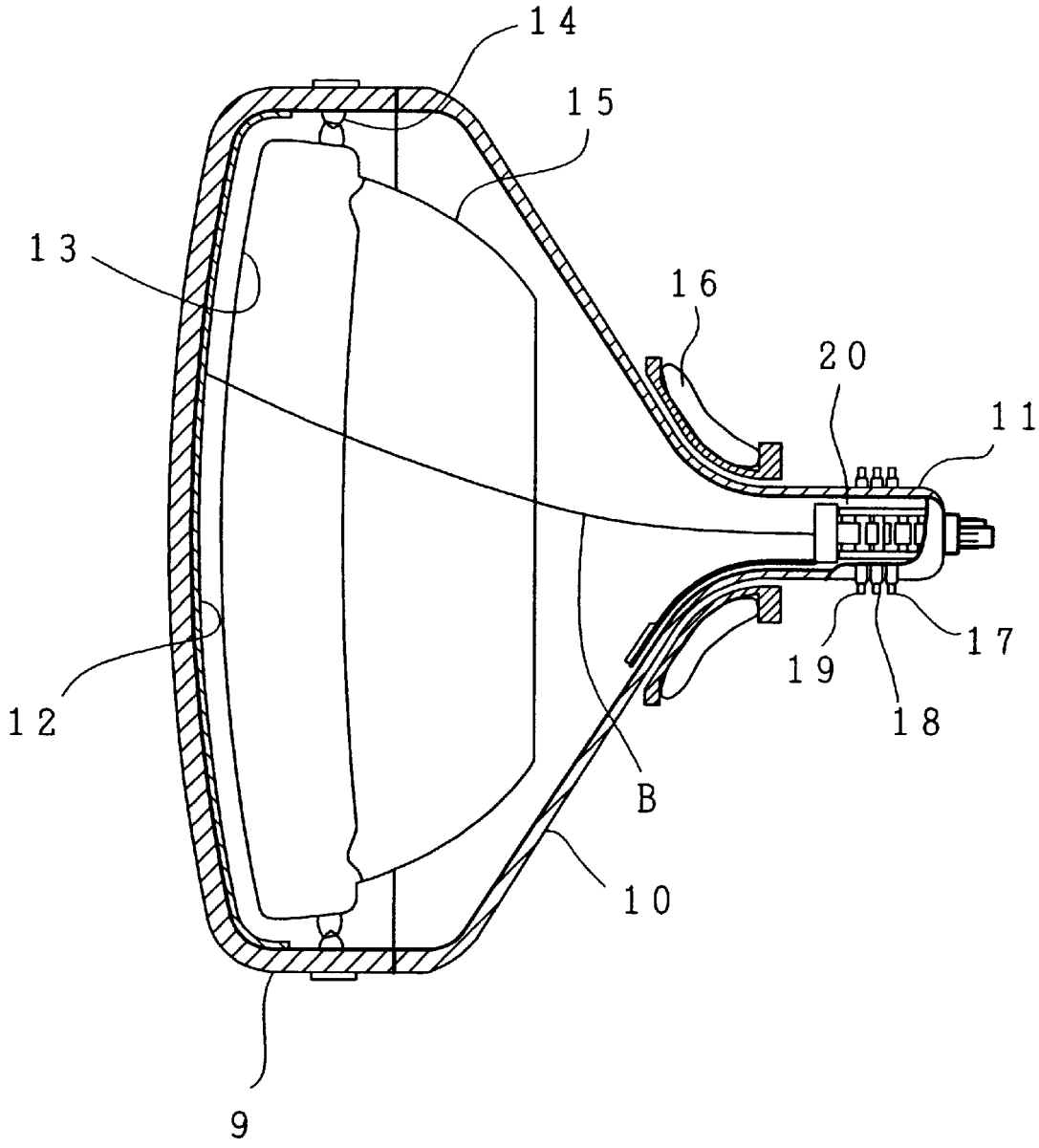
FIG. 4 is a cross section of a cathode ray tube of the type to which the present invention is directed.

FIG. 4 is a sectional diagram showing a typical construction of a cathode ray tube of the type to which this invention is applied. The cathode ray tube has a panel 9, a funnel 10, a neck portion 11, a phosphor screen 12 (picture screen), a shadow mask structure 13, panel pins 14 for supporting the shadow mask, a magnetic shield 15, a deflection yoke 16, a purity adjustment magnet 17, a center beam static convergence adjustment magnet 18, a side beam static convergence adjustment magnet 19, and an electron gun 20 for producing an electron beam B.

Electron beams B for red (R), green (G) and blue (B) phosphors are emitted from the electron guns 20 and are deflected in horizontal and vertical directions by the deflection yoke 16 on their way to the phosphor screen so that they are scanned two-dimensionally over the phosphor screen 12 formed on the inner surface of the panel 9 to form an image on the screen. At this time, the electron beams for red (R), green (G) and blue (B) phosphors are selected by the shadow mask installed inside the panel and impinge on the phosphors of corresponding colors, causing these phosphors to emit light and form an image on the phosphor screen.

The shadow mask structure 13 comprises a shadow mask having a large number of electron beam passing openings, a support frame for holding the shadow mask, and mask springs for holding the support frame inside the panel of the color cathode ray tube. The shadow mask structure 13 is suspended inside the panel 9 and is supported through the mask springs on the panel pins 14 embedded in the panel 9.

Figure 5:
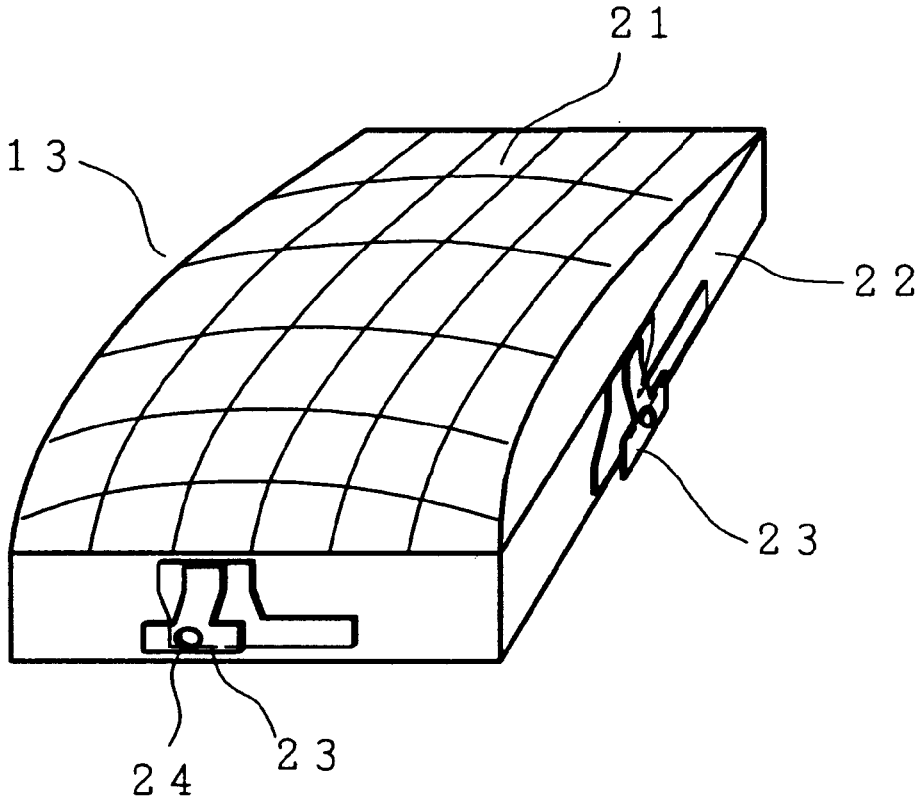
FIG. 5 is a perspective view diagrammatically showing a shadow mask structure of this invention.

FIG. 5 is a schematic diagram showing the shadow mask structure of this invention. The shadow mask structure includes a shadow mask 21 having a plurality of electron beam passing openings for color selection, a support frame 22 for holding the shadow mask 21, and mask springs 23 for holding the support frame 22 inside the panel. The shadow mask structure 13 is held by the panel pins 14 formed on the panel, the pins 14 fitting into mask spring support holes 24 of the shadow mask structure.

Figure 6:
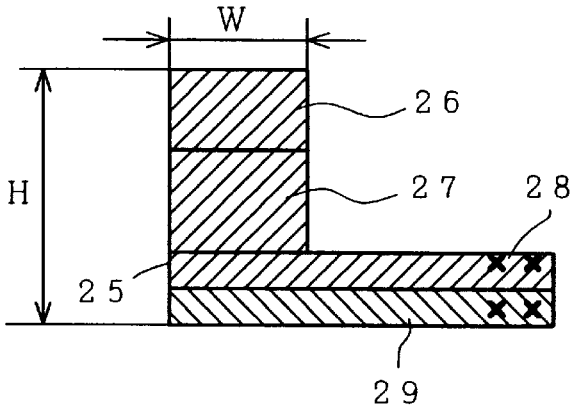
FIG. 6 is a front sectional view of a base plate forming the mask springs of this invention.
Figure 7:
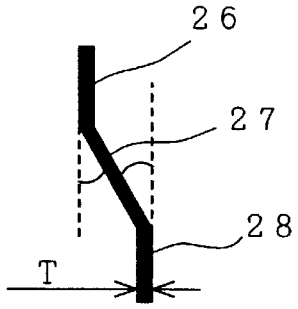
FIG. 7 is a side view of the base plate forming the mask springs of this invention.

FIGS. 6 and 7 are diagrams showing a base plate that forms a mask spring used in the cathode ray tube of this invention. FIGS. 6 and 7 are a front and a side view, respectively, with like reference numerals designating identical parts. Reference numeral 25 generally represents a base plate having an upper portion 26, an inclined portion 27 and a lower portion 28, and symbols X represent welding points where the base plate 25 is welded to the support frame. The mask spring, when viewed from the front, has a height H in the Y-axis direction, a width W in the X-axis direction, and a thickness T in the Z-axis direction. The base plate 25 is L-shaped and is formed as one integral plate comprising two plates of different metals joined together. The base plate lower portion 28 has a metal part on the phosphor screen 12 side (hereinafter referred to as an upper side) and a metal part 29 on the electron gun 20 side (hereinafter referred to as a lower side). The upper metal part, which includes the portions 26, 27 and 28, has a smaller expansion coefficient than that of the lower metal part 29. The upper metal part of the base plate 25 of FIG. 6 is made of SUS42OJ2 and the lower metal part 29 is made of SUS304. Thus, a bimetal function is given to the base plate lower portion, which is fixedly welded to the support frame.

The width of the base plate upper portion 26 is smaller than that of the base plate lower portion 28, and a width of only about 16–20 mm is large enough to withstand unwanted deformation. As shown in FIG. 7, the base plate upper portion 26 and the base plate inclined portion 27 form an angle between them, which angle is approximately 5–15°. There is an angle between the base plate inclined portion 27 and the base plate lower portion 28, which angle is about 5–15°. By these angles of the base plate, the manufacture of the cathode ray tube is facilitated. However, this angular arrangement is not necessarily required by the invention, since the base plate upper portion 26, the base plate inclined portion 27 and the base plate lower portion 28 also may be disposed in one plane. The thickness of the base plate 25 is 0.8–1.2 mm.

Figure 8:
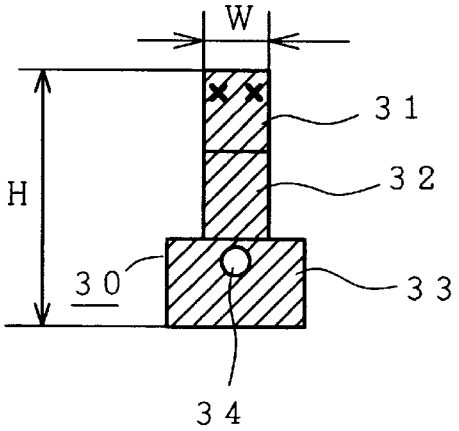
FIG. 8 is a front sectional view of a joined plate forming the mask springs of this invention.
Figure 9:
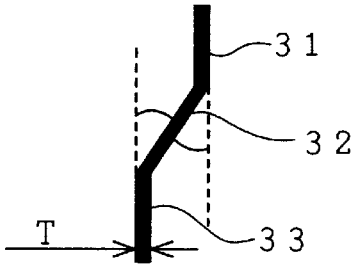
FIG. 9 is a side view of the joined plate forming the mask springs of this invention.

FIGS. 8 and 9 are diagrams showing a joined plate that forms a mask spring for use in the cathode ray tube of this invention. FIG. 8 and FIG. 9 are a front view and a side view, respectively, of the joined plate, with like reference numerals designating identical parts. Reference numeral 30 generally denotes a joined plate having a joined plate upper portion 31, a joined plate inclined portion 32, a joined plate lower portion 33 and an engagement hole 34 for the panel pin, and symbols X denote welding points where the plate 30 is welded to the base plate 25. The joined plate 30 only needs to have a smaller expansion coefficient than that of the lower metal part 29 of the base plate 25 and may be made of the same material SUS42OJ2 as that of the upper metal part of the base plate 25.

The joined plate upper portion 31 is welded to the base plate upper portion 26. The width of the joined plate upper portion 31 is smaller than that of the base plate upper portion 26; in this regard, about 7–20 mm is large enough to produce a sufficient strength and still allow the shadow mask structure to move. As shown in FIG. 9, an angle is formed between the joined plate upper portion 31 and the joined plate inclined portion 32, which angle is about 25–450. There is also an angle between the joined plate inclined portion 32 and the joined plate lower portion 33, which angle is about 25–45°. By these angles of the joined plate 30, the shadow mask structure can be moved easily. The thickness of the joined plate 30 is 0.5–0.8 mm.

Figure 10:
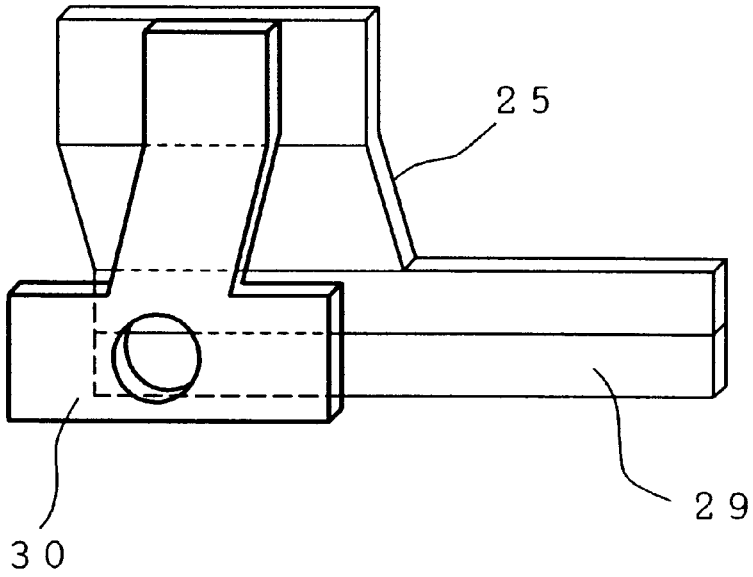
FIG. 10 is a perspective view of a mask spring of this invention.

FIG. 10 is a schematic diagram of the mask spring formed by welding the base plate 25 to the joined plate 30. Referring to this figure, the construction of the mask spring and the action of the bimetal element will be described. The base plate 25 is a bimetal element in which the upper metal part has a smaller expansion coefficient than that of the lower metal part 29. The joined plate 30 is rotatable about the inserted panel pin at the fitting portion. Thus, since the base plate 25 deflects due to an ambient temperature change, the welding points where it is welded to the support frame move toward the electron gun, and, consequently, the shadow mask structure also moves toward the electron gun.

Because the base plate 25 moves the shadow mask structure due to its bimetal structure, a change in the width of the bimetal structure can control the amount of movement of the shadow mask structure. It is desirable that the base plate 25 is not deformed except by action of the bimetal. Thus, the widths and thicknesses of the base plate upper portion 26 and the base plate inclined portion need to be so set that the base plate 25 will not be deformed when moving the shadow mask structure to correct the electron beams.

In such a way, the electron beam drift caused by changes in the ambient temperature can be corrected. Although the above description has been made for only the case where the ambient temperature rises, a correction can also be achieved when the temperature lowers.

Figure 11:
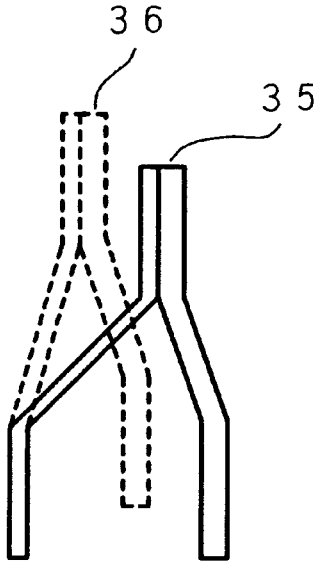
FIG. 11 is a side view of the mask spring of this invention.

FIG. 11 is a schematic diagram showing how the mask spring acts. Referring to this figure, the action of the mask spring will be described. In the shadow mask structure, the expansion of the support frame enlarges itself circumferentially outwardly, which in turn applies a force to the base plate 25 toward the panel sidewall. The spring 36, shown in dashed line, is in a state where no force toward the panel sidewall is applied to it, and the spring 35, shown in solid line, is in a state where a force toward the panel sidewall is applied to it.

The joined plate 30 has its thickness and width preset in a range that allows the joined plate to be deformed by the expansion of the support frame. Because the welding portion where the base plate 25 is welded to the joined plate 30 is closer to the phosphor screen side than the welding portion where the support frame is welded to the mask spring, the base plate 25 moves not only toward the panel sidewall, but also toward the phosphor screen. As a result, the shadow mask structure moves toward the phosphor screen.

The amount of displacement of the shadow mask can be controlled by changing the length of the joined plate inclined portion. The joined plate upper portion 31 needs to have a width which prevents it from deforming when the cathode ray tube falls and which still allows the shadow mask to be moved. By changing the widths and thicknesses of the base plate 25 and the joined plate 30, their strengths can be set and the amount of displacement of the shadow mask can be controlled. Moving the shadow mask structure in such a way can correct the electron beam drift resulting from the expansion of the support frame when the cathode ray tube is operated for a long period of time.

Figure 12:
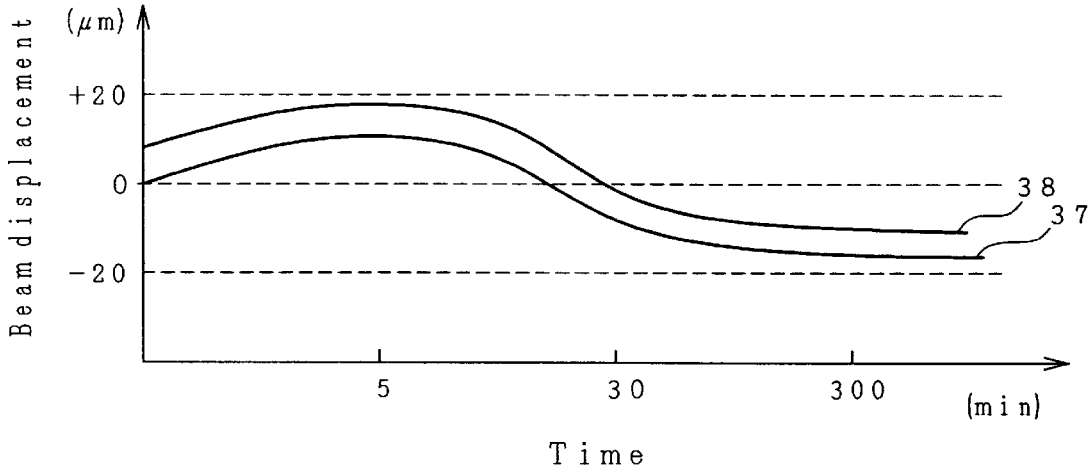
FIG. 12 is a graph showing the amount of electron beam displacement in the cathode ray tube of this invention.

FIG. 12 shows the amounts of electron beam displacement in the cathode ray tube of this invention. When an electron beam that has passed through the same electron beam passing opening apparently moves toward the panel center when viewed from the front of the panel, the displacement is given a plus (+) sign. When it apparently moves outward, the displacement is given a minus (–) sign.

In a cathode ray tube which has been optimally set at the ambient temperature of 20° C. when manufactured, for example, the electron beam displacement at the ambient temperature of the cathode ray tube of 20° C. is represented by line 37, and the electron beam displacement at the ambient temperature of 40° C. is represented by line 38. As shown in the figure, the space between lines 37 and 38 is narrow, which means that the ambient temperature drift is improved. As for the long time drift, because the shadow mask is moved toward the phosphor screen, the amount of the electron beam drift can be reduced. That is, if the cathode ray tube of this invention is operated at the ambient temperature of 20° C. or 40° C. for a long period of time, the electron beam displacement is as shown in the figure and the amount of electron beam displacement in the plus or minus direction can be suppressed to below 20 $\mu$m. Thus, two kinds of electron beam drift, the ambient temperature drift and the long time drift, can be improved.

As long as the mask spring has an L-shaped member with a bimetal action and a joined member secured to one end of the L-shaped member, the cathode ray tube of this invention can produce a similar effect by changing the positional relation between the joining position where the L-shaped member is joined to the joined member, and the welding position where the mask spring is welded to the support frame, the positional relation between the metal materials of the bimetal, and the positional relation between the L-shaped member and the joined member.

As described above, this invention is particularly suited for a cathode ray tube having a shadow mask structure in which a material with a relatively small expansion coefficient, such as invar, is used for the shadow mask, and a material with a larger expansion coefficient than that of the shadow mask is used for the support frame.

What is claimed is:

1. A color cathode ray tube comprising a generally rectangular shadow mask structure including a shadow mask, a support frame for holding the shadow mask, shadow mask springs for holding the support frame inside a panel having a phosphor screen adjacent thereto, and panel pins for holding the shadow mask structure, wherein each of the shadow mask springs comprise an L-shaped base plate and a joined plate secured to one end of the base plate, the base plate has a phosphor screen side metal portion and an electron gun side metal portion, the phosphor screen side metal portion has a smaller thermal expansion coefficient than a thermal expansion coefficient of the electron gun side metal portion, an other end of the base plate is secured to a side of the support frame, the joined plate is engageable with one of the panel pins, and the secured portion of the one end of the base plate and the joined plate is located at a position closer to the phosphor screen than the secured portion of the other end of the base plate and the support frame.

2. A color cathode ray tube according to claim 1, wherein the joined plate is bent at two positions along the tube axis at an angle of between 25° and 45° to form generally parallel surfaces.

3. A color cathode ray tube according to claim 1, wherein the base plate is bent at two positions along the tube axis at an angle of between 5° and 15° to form generally parallel surfaces.

4. A color cathode ray tube according to claim 1, wherein the base plate is 0.8–1.2 mm thick and the joined plate is 0.5–0.8 mm thick.

5. A color cathode ray tube according to claim 1, wherein the base plate is welded to the joined plate, the base plate is 16–20 mm wide at the welded portion, and the joined plate is 7–20 mm wide at the welded portion.

* * * * *